United States Patent [19]

Mrenna et al.

[11] 4,030,060

[45] June 14, 1977

[54] THERMALLY ADJUSTABLE CIRCUIT BREAKER

[75] Inventors: Stephen A. Mrenna, Beaver; Charles E. Haugh, New Brighton; Glenn R. Thomas, Beaver, all of Pa.

[73] Assignee: Westinghouse Electric Corporation, Pittsburgh, Pa.

[22] Filed: Feb. 26, 1976

[21] Appl. No.: 661,592

[52] U.S. Cl. ..... 337/50; 337/129

[51] Int. Cl.[2] ..... H01H 71/14

[58] Field of Search ..... 337/46, 48, 50, 55, 337/129, 357; 335/42, 45, 176

[56] References Cited

UNITED STATES PATENTS

| | | | |
|---|---|---|---|
| 3,758,887 | 9/1973 | Ellsworth et al. | 335/42 |
| 3,949,331 | 4/1976 | Cellerini et al. | 335/45 |
| 3,950,714 | 4/1976 | Mrenna et al. | 335/45 |

*Primary Examiner*—William H. Beha, Jr.
*Attorney, Agent, or Firm*—L. P. Johns

[57] ABSTRACT

A multi-pole circuit breaker characterized by a circuit breaker structure including a releasable arm for opening a circuit through the breaker, a bimetal element for each pole which is responsive to an overload current condition to effect release of the releasable arm, a latch bracket and a trip bar coaxially mounted and having an adjustment screw to vary the position of the trip bar in relation to the bimetal to change thermal rating of the circuit breaker.

5 Claims, 1 Drawing Figure

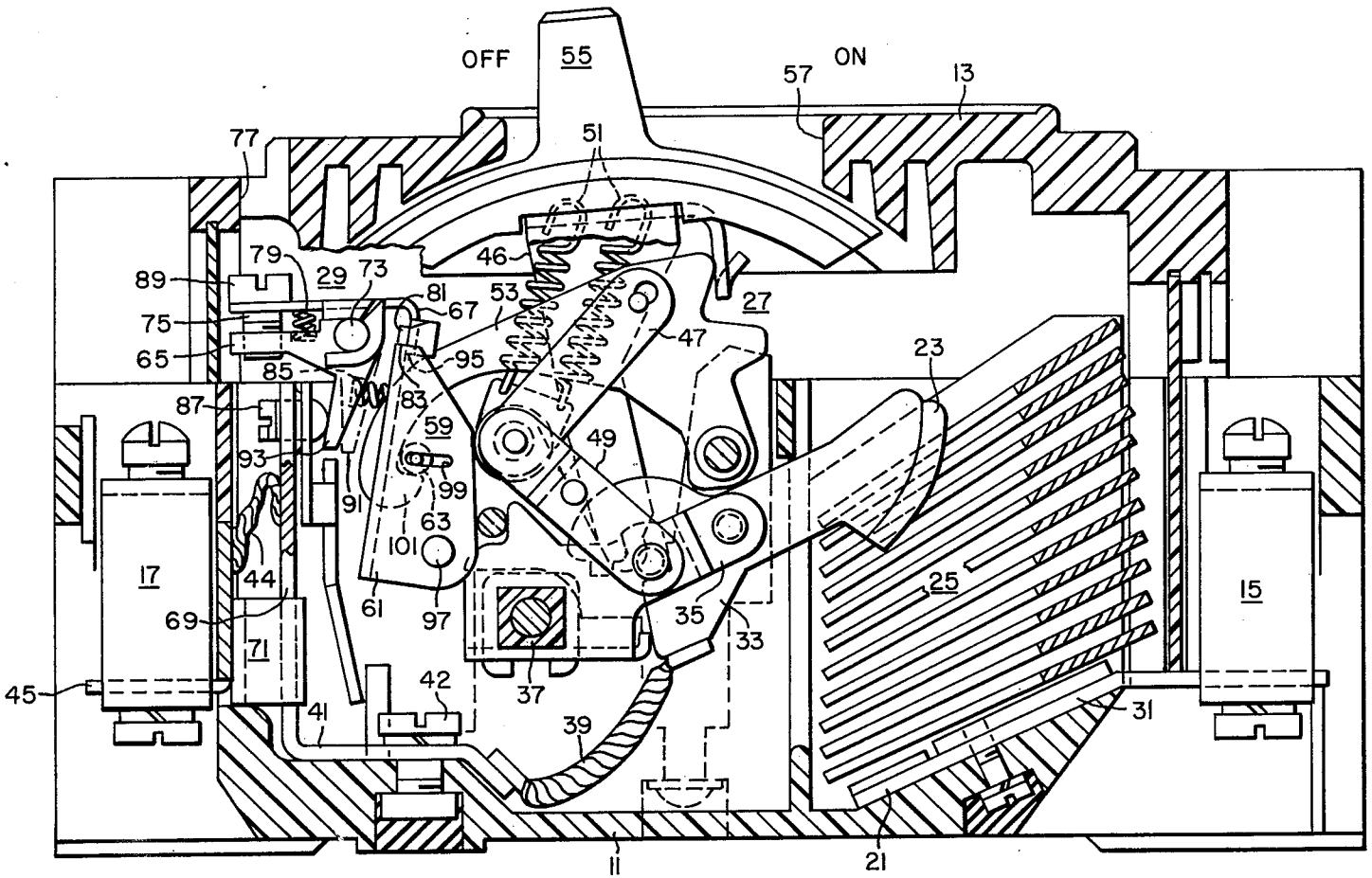
ON
OFF
55
57
13
15
17
21
23
25
27
29
31
33
35
37
39
41
42
44
45
46
47
49
51
53
59
61
63
65
67
69
71
73
75
77
79
81
83
85
87
89
91
93
95
97
99
101
11

THERMALLY ADJUSTABLE CIRCUIT BREAKER

BACKGROUND OF THE INVENTION

1. Field of the Invention

This invention relates to circuit breakers having thermally adjustable trip means.

2. Description of the Prior Art

The conventional thermal tripping mechanism of a circuit breaker is well known in the art and consists mainly of a movable trip bar which carries a releasable latch. As shown in U.S. Pat. No. 3,211,860, the trip bar is actuated by adjacent bimetal strips which respond to temperature generated by an overload current flowing to the circuit breaker. The circuit breaker of the type shown in that patent is a fixed calibrated circuit breaker which is set for a given amperage rating which has been conventional for the circuit breaker used in some countries such as the United States. In other countries there is a preference for manually adjustable thermal tripping devices to change thermal rating of the circuit breaker to suit load requirements.

SUMMARY OF THE INVENTION

In accordance with this invention, a multi-pole circuit braker is provided which comprises a circuit breaker mechanism having a plurality of pole units, each pole unit comprising a pair of contacts, releasable means including a releasable arm to effect simultaneously opening of all of said pairs of contacts, trip means for each of said pole units, each trip means comprising a bimetal element being responsive to the occurrence of certain overload current conditions to effect release of the releasable means, the trip means also comprising a trip bar and a latch bracket, the trip bar being mounted to oscillate between latched and unlatched positions, the latch bracket being pivotally mounted with respect to the trip bar and being movable between latched and unlatched positions of the releasable arm and being urged to the unlatched position by the releasable arm, the trip bar being in the path of movement of the bimetal to effect movement of said bracket when said element responds to an overload current, and an adjustment screw on the trip bar to control spacing between the trip bar and the latch bracket.

The advantage of the device of this invention is that a circuit breaker may be manually calibrated to adjust the thermal rating as much as 30% from maximum to minimum settings.

BRIEF DESCRIPTION OF THE DRAWING

The accompanying drawing is a vertical sectional view illustrative of the apparatus of the present invention.

DESCRIPTION OF THE PREFERRED EMBODIMENT

The circuit interrupter shown in the drawing is a three-pole circuit breaker and comprises generally a base 11, a removable cover 13, both of which are molded from suitable electrically insulating material. Inasmuch as a detailed description of the circuit breaker is set forth in U.S. Pat. No. 3,460,075, the description of the circuit breaker portion is limited to the parts that are essential to the operation of the invention disclosed herein.

Each of the three-poles is provided with terminals at opposite ends of the base 11 indicated generally at 15 and 17. The circuit breaker includes a stationary contact 21, a movable contact 23, and an arc extinguisher indicated generally at 25 for each pole unit. A common operating mechanism generally indicated at 27 is provided for simultaneously actuating the three movable contacts to open and close positions. A trip device generally indicated at 29 automatically opens the contacts 21, 23 in response to predetermined overload conditions in a circuit through any pole unit of the breaker. The terminal 15 is disposed at the outer end of a conductor 31 that extends into the housing and rigidly supports the stationary contact 21. The movable contact 23 of each pole unit is mounted on a rigid contact arm 33, which is supported on a switch arm 35 secured to a tie bar 37 which extends across all of the pole units and supports all of the switch arms 35 for unitary movement to the open and closed positions. The contact arm 33 is connected by a flexible conductor 39 to a conductor 41 that is secured at one end to the base 11 by a screw 42. The L-shaped conductor 41 extends into the trip unit 29 and is connected by a flexible conductor 44 to another conductor 45 that extends to the terminal 17. Thus, a circuit through the circuit breaker extends from the terminal 17, through the conductors 45, 44, 41, 39, the contact arm 33, the contact 23, 21, and the conductor 31 to the terminal 15.

The operating mechanism 27 comprises a pivoted operating lever 46, a pair of toggle links 47, 49, over center spring means 51, and a pivoted releasable arm 53 which is controlled by the trip device 29. An integral handle 55 extends through an opening 57 in the cover 13 to enable manual operation of the breaker between OFF and ON positions.

The releasable arm 53 is latched in the position shown in the drawing by a latch mechanism 59 which comprises a roller latch 61 having a latch roller 63, a trip bar 65, a latch bracket 67, and a bimetal element 69. The bimetal element 69 is mounted at its lower end on the conductor 41. In addition, the trip device comprises a separate thermal-and-magnetic trip means 71 for each pole unit in a manner similar to that set forth in the U.S. Pat. No. 3,460,075.

In accordance with this invention, the trip bar 65 which is common for all pole units is pivotally mounted on a pin 73 and the latch bracket 67 is pivotally fastened to the trip bar by bearings on the same axis as the pin. An adjusting screw 75 is threaded into the trip bar 65. Access to the screw 75 is had through an access opening 77 in the cover 13. A compression spring 79 biases the latch bracket 67 against the head of the adjusting screw 75. A stop pin 81 is provided on the latch bracket 67 and engages the upper end of the rotor latch 61 at 83.

A compression spring 85 biases the trip bar 65 clockwise until it is stopped by the stop pin 81 and/or a bimetal calibrating screw 87, which is disposed at the upper end of the bimetal element 69. The position of the trip bar 65 in relation to the bimetal element 69 can be varied by turning the adjusting screw 75 to the desired thermal rating (not shown) on the knob 89 of the screw. Rotation of the screw causes the trip bar to move between various positions such as indicated by the broken line position 91, whereby the relationship between the trip bar and the latch bracket can be varied and maintained. For example, threads on the adjusting screw 75 are 16 threads per inch in order to obtain a 30% adjustment. One full turn (360°) changes the up and down movement of the trip bar 1/16 inch, which is required to change the rating 30%.

In operation, upon the occurrence of an overload above a predetermined value in any of the pole units, the current flowing through the bimetal element 69 causes, either thermally or magnetically, the bimetal to move clockwise against the downturn portion 93 of the trip bar 65 to lift the end 95 of the latch bracket 67 above the upper end 83 of the roller latch 61 which is pivoted at 97. As a result the roller 63 moves along the slot 99 and disengages the lower hooked portion 101 of the releasable arm 53, thereby automatically causing the operating mechanism 27 to open the contacts 21, 23 to the position shown in the drawing.

In conclusion, the adjustable thermal tripping mechanism of this invention enables controlled variation of the distance between the bimetal and the trip bar simultaneously for all poles of the circuit breaker and thus changes the thermal rating of the breaker from maximum to minimum settings.

What is claimed is:

1. A multi-pole circuit breaker comprising a circuit breaker structure having a plurality of pole units, each pole unit comprising a pair of contacts, releasable means including a releasable arm to effect simultaneous opening of all of said pairs of contacts, trip means for each of said pole units, each trip means comprising a bimetal element being responsive to the occurrence of certain overload current conditions to effect release of the releasable means, the trip means also comprising a trip bar and a latch bracket, the trip bar being mounted to oscillate between latched and unlatched positions, the latch bracket being pivotally mounted with respect to the trip bar and being movable between latched and unlatched positions of the releasable arm and being urged to the unlatched position by the releasable arm, the trip bar being in the path of movement of each of the bimetal elements to effect movement of said bracket when any one of said elements responds to an overload current, and adjustment means between the trip bar and the latch bracket for varying the distance between the bimetal elements and the trip bar.

2. The multi-pole circuit breaker of claim 1 in which the adjustment means comprises a screw to control the spacing between the trip bar and the latch bracket.

3. The multi-pole circuit breaker of claim 2 in which the trip bar and the latch bracket include overlying portions, and in which the screw extends between them.

4. The multi-pole circuit breaker of claim 3 in which the trip bar and the latch bracket are pivotally mounted on the same axis.

5. The multi-pole circuit breaker of claim 4 in which rotation of the trip bar by any of the bimetal elements causes rotation of the latch bracket to an unlatched position of the releasable arm.

* * * * *